US007033214B2

(12) United States Patent
Vantouroux

(10) Patent No.: US 7,033,214 B2
(45) Date of Patent: Apr. 25, 2006

(54) CONNECTOR FOR ELECTRICAL CONDUCTORS THAT INCLUDE A CONTACT/LOCKING END-FITTING AT THEIR END TO BE CONNECTED

(75) Inventor: Patrick Vantouroux, Fleury les Aubray (FR)

(73) Assignee: Amphenol-Air LB, Colombes (FR)

( * ) Notice: Subject to any disclaimer, the term of this patent is extended or adjusted under 35 U.S.C. 154(b) by 0 days.

(21) Appl. No.: 10/634,128

(22) Filed: Aug. 4, 2003

(65) Prior Publication Data

US 2004/0132340 A1 Jul. 8, 2004

(30) Foreign Application Priority Data

Aug. 9, 2002 (FR) ..... 02 10171

(51) Int. Cl.
*H01R 13/40* (2006.01)

(52) U.S. Cl. ..... 439/587

(58) Field of Classification Search ..... 439/586–603, 439/278–282

See application file for complete search history.

(56) References Cited

U.S. PATENT DOCUMENTS 2,115,556 A 4/1938 Maniscalco
2,575,912 A 11/1951 Doyle
2,824,290 A * 2/1958 Archer et al. ..... 439/294
3,125,395 A * 3/1964 Archer et al. ..... 439/660
3,308,421 A * 3/1967 White ..... 439/599
3,477,061 A * 11/1969 Stephenson ..... 439/589
3,638,165 A * 1/1972 Anhalt et al. ..... 439/586
4,544,220 A * 10/1985 Aiello et al. ..... 439/594
4,684,187 A * 8/1987 Rudy et al. ..... 439/600
6,000,966 A * 12/1999 Dechanteloup et al. ..... 439/595
6,042,428 A * 3/2000 Espiritu et al. ..... 439/686
6,065,999 A * 5/2000 Radliff ..... 439/595
6,196,873 B1 * 3/2001 Murakami et al. ..... 439/595
6,398,585 B1 * 6/2002 Fukuda ..... 439/587

FOREIGN PATENT DOCUMENTS

EP 866 521 9/1998
FR 2 742 264 6/1997

* cited by examiner

*Primary Examiner*—Alexander Gilman
(74) *Attorney, Agent, or Firm*—Meyertons, Hood, Kivlin, Kowert & Goetzel, P.C.

(57) ABSTRACT

A connector for electrical conductors that have, on their ends to be connected, contact/locking end-fittings designed to be inserted into electrically insulated locking members that are retained inside a connector body or case, characterized in that the method for retaining the locking members inside the case and for electrically insulating them consists of a single retention and insulation element produced as a single part, made of an elastomer, by overmoulding of the locking members directly in the body so as to surround the locking members on the side of the case and at least on the rear side of the connector and having here openings for the insertion of the end-fittings and for the sealed passage of the conductors fitted with the end-fittings.

2 Claims, 1 Drawing Sheet

CONNECTOR FOR ELECTRICAL CONDUCTORS THAT INCLUDE A CONTACT/LOCKING END-FITTING AT THEIR END TO BE CONNECTED

BACKGROUND OF THE INVENTION

1. Field of the Invention

The present invention relates to a connector for electrical conductors that have, at their end to be connected, contact/locking end-fittings designed to be inserted into locking members that are retained within a connector body or case and are electrically insulated.

2. Description of the Related Art

Connectors and connection devices for such electrical conductors are known, for example from French Patent Nos. 2,115,556 and 2,575,912, to which reference may be made for further details regarding the contact/locking end-fittings that are fixed to the ends of the conductors and to the locking members into which these end-fittings are designed to be inserted.

In all connectors of this type, the locking members are retained by one or two insulating elements that are themselves retained in a connector body or case by a large variety of mechanical methods. In addition to these mechanical retention methods, a method of resilient sealing, having passages for the insertion of the contact/locking end-fittings, is provided on the rear side of the connector. A method of sealing may also be provided on the front side of the connector.

This multiplicity of methods of retention and methods of sealing complicate the manufacture of the connector and increase its cost.

SUMMARY OF THE INVENTION

The aim of the present invention is to provide a connector of the type defined above that is distinguished, in particular, by the simplicity of the method for retaining and sealing the locking members in the connector body or case, by the quality of the sealing afforded by this method, and by a low cost of the connector.

The connector according to the invention is designed for electrical conductors that have, on their end to be connected, contact/locking end-fittings designed to be inserted into locking members that are retained inside a connector body or case and are electrically insulated. In the connector according to the invention, the method of retention and electrical insulation includes a single retention and insulation element produced as a single part, made of an elastomer, by overmoulding of the locking members directly in the body or case so as to surround the locking members on the side facing the case and at least on the rear side of the connector and having here openings for the insertion of the end-fittings and for the sealed passage of the conductors fitted with the end-fittings.

This arrangement, therefore, makes it possible to dispense with all the mechanical methods for retaining the locking members in the connector body or case with this function along with the sealing function on the rear side of the connector now provided by a single element made of an elastomer formed directly in the connector body or case by overmoulding.

Preferably, the said retention and insulation element may be produced from a single part so as also to surround the locking members on the front side of the connector having here openings for the sealed passage of the contacts.

This arrangement makes it possible to simplify the connector and provide better sealing with the same element made of an elastomer and formed by overmoulding. The element surrounds the locking members on both sides while ensuring that the elements are retained in the connector body or case.

BRIEF DESCRIPTION OF THE DRAWINGS

A connector according to the prior art and a connector produced according to the teaching of the present invention will be described below in greater detail with reference to the appended drawings; in the drawings.

DETAILED DESCRIPTION OF THE INVENTION

Figure 1:
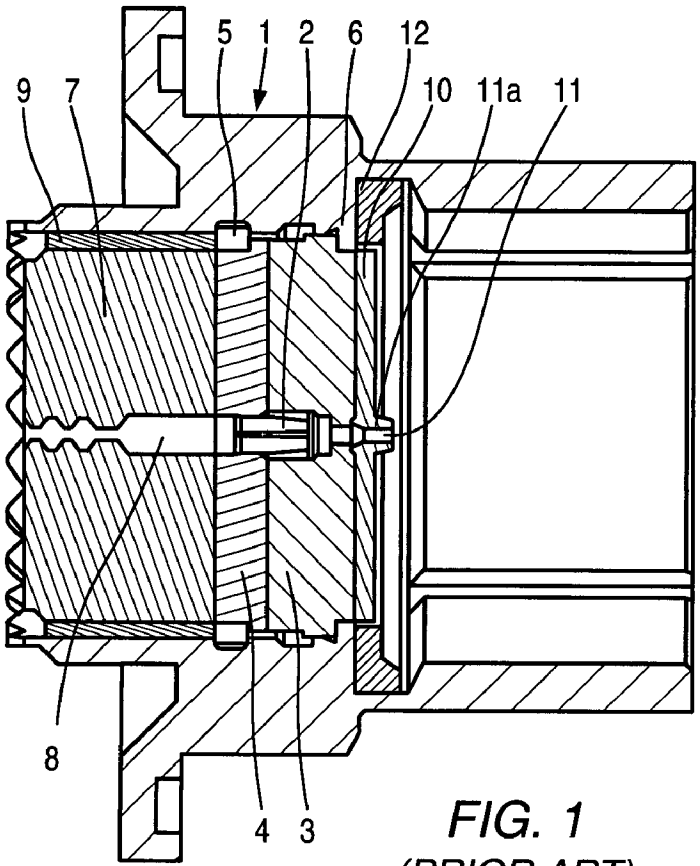
FIG. 1 (PRIOR ART)
FIG. 1 is an axial section of half a connector according to the prior art.

In FIG. 1, a connector half, which may either be a socket (i.e., fixed half) or a plug (i.e., moveable half), includes a body or case 1 inside which locking members 2 are positioned, only one of them being visible in the figure. Each locking member 2, which is for example in the form of retention ribs of a type known per se, is designed to receive a locking/contact end-fitting (not shown) fixed in a known manner, for example by crimping, on the end of a conductor to be connected. The end-fitting in question may either be a male contact or a female contact designed to cooperate with a corresponding female contact or a male contact of another connector half (not shown).

Locking member 2 is placed between two insulating elements 3 and 4 and is made as one piece with one of the elements, namely the element denoted by the reference 4. These elements 3 and 4 are retained in case 1 by a retention element 5, for example of the "snap-ring" type that cooperates with element 4 in order to keep element 3 butted against an internal shoulder 6 of case 1.

For the purpose of sealing the connector, an element 7, made of an elastomer, having a through-opening 8 aligned with locking member 2, is placed on the rear side of the connector in case 1 with a sealing compound 9 providing the seal between element 7 and case 1. On the front side, a sealing element 10, having along the axis of each locking member 2 a through-hole 11 extended by a nipple 11*a*, is placed against the front face of element 3. In addition, sealing washer 12 is put into case 1, in the plane of sealing element 10. Washer 12 is designed to be compressed axially when the two connector halves are assembled in order to cooperate in a sealed manner with element 10 and with the case of the other connector half.

To manufacture the connector according to FIG. 1, it is necessary to assemble elements 3 and 4, for example by adhesive bonding, and then to fasten sealing element 7 to element 4, for example by adhesive bonding, to fasten sealing element 10 to element 3, for example by adhesive bonding, then to mount this preassembled assembly in case 1, to mechanically retain it in the case using retention element 5, to introduce sealing compound 9 between element 7 and case 1, and to fasten seal 12 in case 1.

Despite this sophisticated and meticulous method of assembly, it is difficult to ensure satisfactory sealing because of the large number of assembly operations involving different materials.

Figure 2:
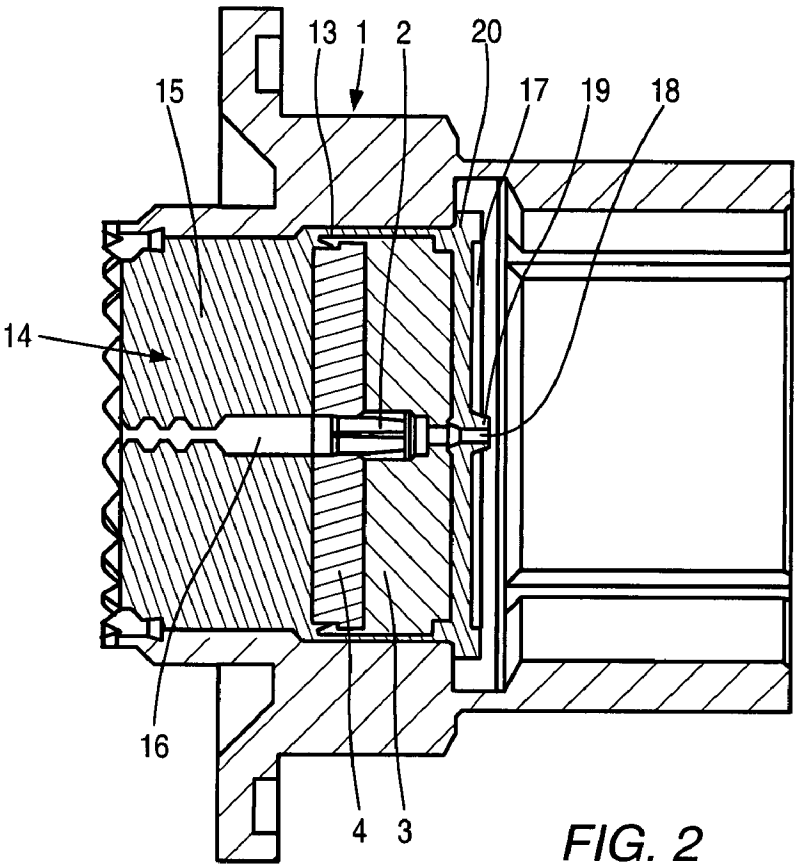
FIG. 2 is a corresponding section of half a connector produced according to the teaching of the present invention.

The connector according to the invention, as illustrated in FIG. 2, includes a body or case 1 corresponding approximately to the body or case 1 of the connector of FIG. 1. Moreover, on the connector according to the invention, there are the same locking members 2 placed between insulating elements 3 and 4, which here are joined together by snap-fastening tabs 13, formed for example as projections on element 3 in order to cooperate with element 4.

The retention of the assembly comprising elements 3 and 4 including the locking members 2 in case 1 and the sealing of the entire connector are provided by a single element 14 that surrounds the module, formed by elements 3 and 4 including the locking members 2, at the same time, on the rear side, on the front side, and on the side facing case 1. Here element 14 forms, on the rear side, a sealing part 15 with through-holes 16 for the end-fittings designed to be inserted into locking members 2 with part 15 being in this regard similar to element 7 in FIG. 1, on the front side, part 17 having through-holes 18 and nipples 19, similar in this regard to element 10 in FIG. 1, and the outer perimeter relative to the body or case 1, thus providing not only retention of the module inside case 1, without any other means, but also perfect sealing. The sealing obtained in this manner is much better than that obtained according to FIG. 1 which includes several sealing elements fastened together.

It should be pointed out that, on the front side of the connector, part 17 is extended radially outwards by a peripheral flange 20 forming a seal to be compressed axially by the case of the other connector half during assembly of the two connector halves ensuring sealing between the cases of the two assembled connector halves.

Element 14, that surrounds, as a single piece, elements 3 and 4 including the locking members 2, providing for its retention in the case and its sealing, is produced by overmoulding of the module placed in its case 1.

Although the invention is applicable to connectors of any shape, it is more particularly suitable for circular connectors.

What is claimed is:

1. A connector for electrical conductors comprising contact/locking end-fittings on the ends of the connector to be connected, the connector comprising:

a connector body or case;

electrically insulated locking members retained inside the connector body or case and designed to receive the contact/locking end-fittings;

two insulating elements which are joined by snap-fastening tabs, the locking members being placed between the two insulating elements; and a single retention and insulation element for retaining the locking members inside the body or case and electrically insulating the locking members, the retention and insulation element being produced as a single part, made of an elastomer, by overmoulding of the locking members directly in the body so as to surround the locking members on the side facing the case and at least on the rear side of the connector and having openings on the rear side of the connector for insertion of the end-fittings and for sealed passage of the conductors fitted with the end-fittings.

2. The connector of claim 1, wherein the retention and insulation element is produced as a single part so as also to surround the locking members on the front side of the connector and having on the front side of the connector openings for sealed passage of the contacts.

* * * * *